US006926145B2

(12) United States Patent
Bartlett

(10) Patent No.: US 6,926,145 B2
(45) Date of Patent: Aug. 9, 2005

(54) ELECTRIC LIGHT STRANDS UTILITY HOLDER

(76) Inventor: Elizabeth L. Bartlett, 64 Melrose Pl., Montclair, NJ (US) 07042

( * ) Notice: Subject to any disclaimer, the term of this patent is extended or adjusted under 35 U.S.C. 154(b) by 95 days.

(21) Appl. No.: 10/458,710

(22) Filed: Jun. 10, 2003

(65) Prior Publication Data

US 2003/0230507 A1 Dec. 18, 2003

Related U.S. Application Data

(60) Provisional application No. 60/388,258, filed on Jun. 12, 2002.

(51) Int. Cl.[7] ..... B65D 85/42; B65H 75/40; B65H 75/24

(52) U.S. Cl. ..... 206/420; 242/388.6; 242/395.1; 242/403.1; 242/557

(58) Field of Search ..... 206/419–420; 211/26, 205; 242/395.1, 590, 609.1, 388.6, 402–406, 557; 206/388

(56) References Cited

U.S. PATENT DOCUMENTS 2,726,820 A * 12/1955 Wilson ..... 242/437.4
3,337,158 A * 8/1967 Ball ..... 242/139
3,694,291 A * 9/1972 McAllister ..... 156/431
5,033,619 A * 7/1991 Garis ..... 206/419
5,064,067 A * 11/1991 McAllister et al. ..... 206/420
5,641,075 A * 6/1997 Mechlin ..... 211/26
5,653,339 A * 8/1997 Dobson ..... 206/420
6,142,405 A * 11/2000 Black ..... 242/388.6
6,398,148 B1 * 6/2002 Snow ..... 242/395.1
6,467,623 B1 * 10/2002 Lewis et al. ..... 206/419
6,557,792 B1 * 5/2003 Snow ..... 242/395.1
6,676,069 B1 * 1/2004 Davis ..... 242/609.1
2003/0080236 A1 * 5/2003 Armstrong ..... 242/557

* cited by examiner

*Primary Examiner*—Bryon P. Gehman
(74) *Attorney, Agent, or Firm*—Charles E. Graves

(57) ABSTRACT

This disclosure describes an electric light strand mounting device for simplifying the installation and removal of light strands from, for example, a holiday tree. The device consists of a light strand receiver and an associated base that rests on a floor or horizontal surface. Indents are provided on the receiver for preventing downward slippage of mounted strands. The receiver is rotatable around a vertical axis; and simultaneously, the base is moveable in any horizontal direction. Both movements are provided in one version, by a unitary base-receiver structure resting on base castors. In another version the receiver is rotatable with respect to a slidable base; but receiver and base are permanently attached to one another. In a third, version, a slidable base and its receiver are mutually rotatable, but are readily detachable from each other by a simple lifting motion. In all versions light strands are installed by feeding one strand at a time onto the receiver as it is rotated. To distribute strands from the receiver to a tree, the device user releases strands by rotative movement while circling the device around the tree. Detachability of base and receiver allows easier storage; and also enables a receiver loaded with stored strands to serve as an alternative light source on its own.

7 Claims, 10 Drawing Sheets

ELECTRIC LIGHT STRANDS UTILITY HOLDER

RELATIONSHIP TO EARLIER APPLICATIONS

This application is based in part on the disclosure contained in Provisional Patent Application Number 60/388,258, filed Jun. 12, 2002.

TECHNICAL FIELD

This invention relates to the storage, management and usage of strands or strings of electric lights, such as decorative or "Holiday" light strands; and more particularly to electric light strand management structures.

BACKGROUND OF THE INVENTION

Placement of light strands on, for example, a Holiday tree typically involves the user first unpacking one or several strands from a storage box or bag. In storage, the strands often are tangled or twisted and must be straightened out by the user before being ready for placement onto the tree. The untangling is done away from the tree, using the floor or a chair. To then connect the strands to the tree, the installer typically will grasp one strand at a time in one hand, and with the other hand place the strand among the branches while circling the tree.

Another approach is for the installer to leave the light strand on the floor or a chair, mount an end of the strand to some point on the tree and walk in a circular path to attach the strand to branches around the tree's perimeter. This approach requires the user to repeatedly re-position the un-installed portion of the strand on the floor or move the chair. Otherwise the un-installed portion will snag around the tree trunk or branches.

The typical take-down process presents similar problems. As the user disengages the strand from the tree with one hand, the removed portion is supported in the other. Alternatively, the user accumulates a pile of light strands on the floor where the bulbs can be inadvertently trampled. The user is constrained typically to disconnecting the several strands to prepare them for storage, although the strands may need to be re-connected in the same sequence for the next use. Further, it is hard to avoid tangling the strands during the act of placing them on the floor and then back in the storage box or bag. The net result is the user having to untangle the strands yet again before their next use.

Once in box or bag storage, the light strands obviously don't have any lighting or decorative utility until they are re-installed back onto a tree or other support. What is needed is a mechanism, which at least avoids the preceding difficulties, by simplifying and speeding up the process of light strand mounting and takedown. The mechanism also must provide efficient storage of the strands when not in use. If in addition the mechanism offers the possibility of putting the strands to a useful purpose while they are in their physical storage configuration, the combination of advantages could be attractive to a user.

SUMMARY OF THE INVENTION

The invention broadly is a light strand mounting device, comprising a strand receiver mounted upright on a base that rests on a floor or horizontal surface. The receiver is rotatable around a vertical axis. Simultaneously, the base is moveable in any horizontal direction.

In one embodiment, the strand receiver is elongate and rectilinear in cross-sections, with rows of indents formed along the narrow opposite edges to receive the strands. Light strands are installed by feeding one strand at a time onto the receiver as it is rotated. The strands are held in place by the indents and thus do not slip down the receiver. As the receiver is rotated during unwinding, the strands readily come free without undergoing twisting or snagging.

To place the stored strands around, for example, a Holiday tree, the installer unreels a length of strand with the base held stationary; and with two hands applies the length of strand to the tree. With the first length installed, the base/receiver assembly is circled to a new location and the operation is repeated. Placement of strands onto the tree and the circling of the tree can occur simultaneously and continuously.

Removal of in-place strands from the tree onto the device is effected by first freeing a given light strand from the tree and fastening it to a receiver indent. As the strand slackens, the receiver is rotated to take up the slack. Removal proceeds by continuing to feed the removed strands onto the receiver while rotating the receiver. Periodically during this operation, the device is advanced in a circle around the tree. On completion of removal, the stored strands are fully ready for installation onto a tree at some future time.

The based and receiver may comprise a permanently assembled entity. The mechanism that enables simultaneous rotation of the receiver and translation of the unitary base/receiver assembly along a horizontal surface, advantageously in this case are castors mounted on the base underside. In another embodiment, the device comprises a receiver mounting that allows the receiver to rotate with respect to the base. In this embodiment, the base may advantageously use sliders for floor contact. Rotation of the receiver is achieved by one of several bearing arrangements that in some instances keep the receiver connected to its base; but in others allow the receiver to be easily detached from the base. One advantage of detachability is that several upright receivers may be employed to store large quantities of light strands; and a single detachable base serves all. A further advantage of detachability is that by providing each upright receiver with a top handle capable of being hung on a rod, for example, the ravels of lights stored on one or several such receivers may be stored in the manner of clothing.

It has been further realized, however, that the strand lights in their raveled, stored position on receivers can additionally serve as attractive and utilitarian light sources. This is enabled by the fact that multiple strands on a given receiver typically stay electrically connected, or can be kept connected at take-down. To "convert" a fully populated upright receiver from an electric light strand storage means to a light source, it is only necessary to provide a way to support the strand bundle; and provide electrical power to it as by an extension cord. The handle enabling its suspension from a rod or the like is one means for supporting. Another option enables each populated upright receiver to function as a ground-supported light source, Enhancing a summer party, for example, with one or more clusters of strand lights displayed in their storage configuration, has utility as novel and effective custom lighting. Strands that are normally stored but are adapted for use as a light source can provide all white, all green, multicolor, or any desired color of light to an area needing illumination or accent lighting.

DETAILED DESCRIPTION

Figure 1:
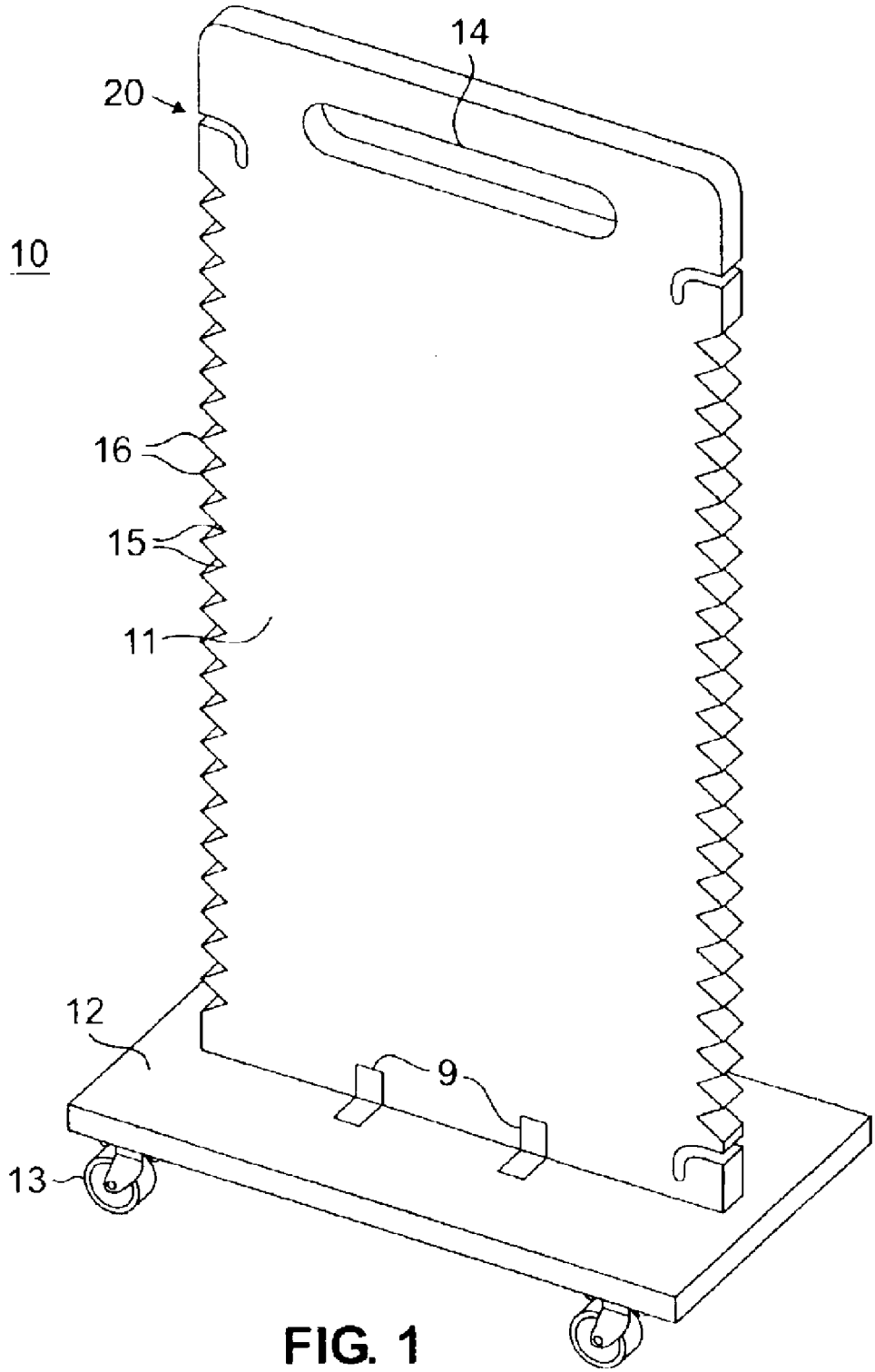
FIG. 1 is an isometric sketch of a first embodiment.

The invention is embodied in a class of electric light strand mounting devices broadly characterized by an ability to translate in a generally circular path in a horizontal plane around an object to be decorated, while at the same to rotate around a vertical axis. In a first embodiment shown in FIG. 1, the device 10 consists of a strand receiver 11 mounted on a base 12 that is supported on castors 13. Receiver 11 is a flat elongate relatively thin-width member fixedly mounted upright on base 12 in various conventional ways such as with brackets 9. A handle 14 facilitates manually moving device 10 on its castors 13 in a horizontal plane around, for example, a Holiday tree 22 in the manner shown in FIG. 5. At the same time, device 10 may be rotated on its castors to rotate receiver 11. Handle 14 also allows device 10 to be lifted as one assembly.

Figure 2B:
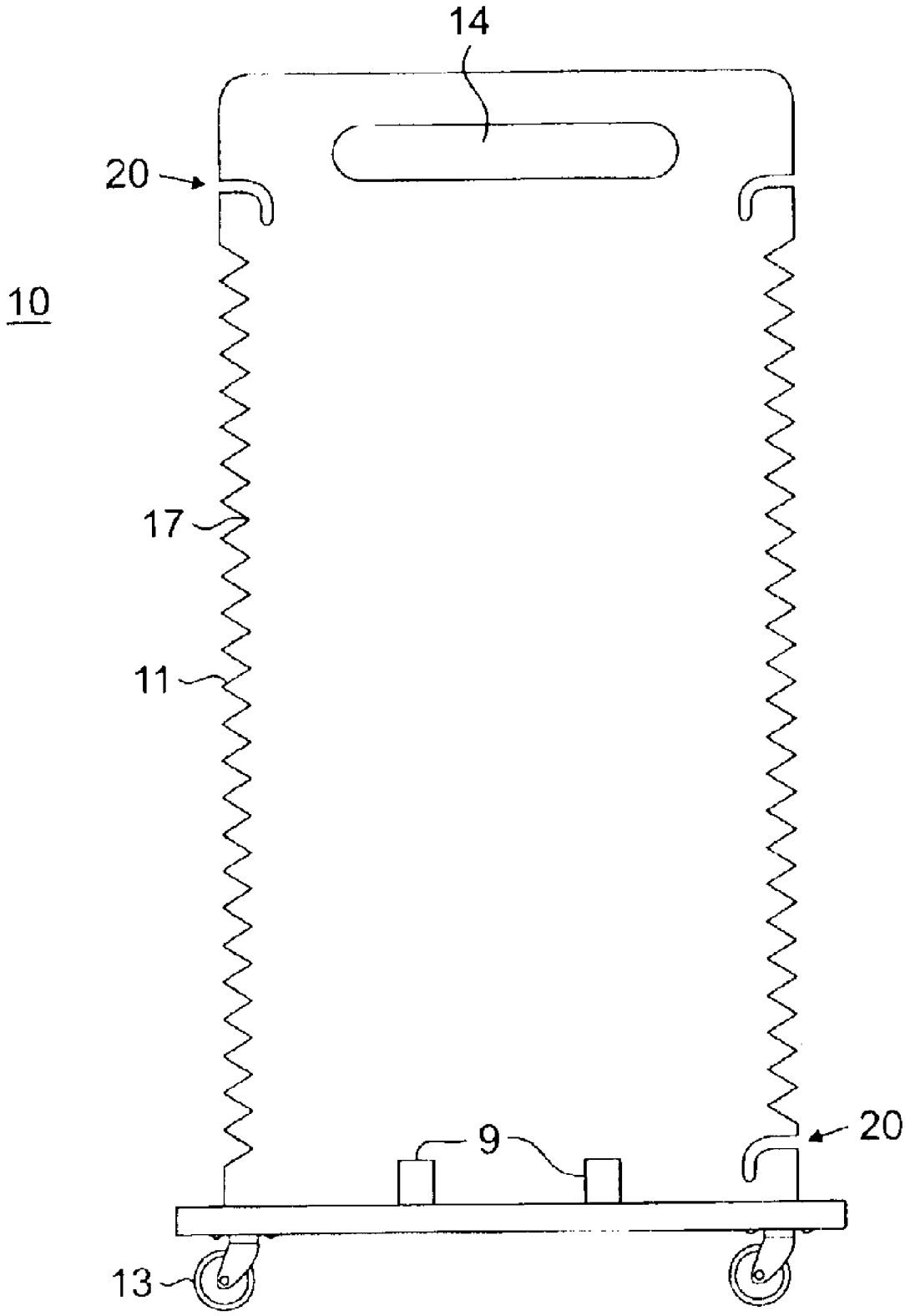
FIG. 2B is an isometric sketch of another alternative receiver.
Figure 3:
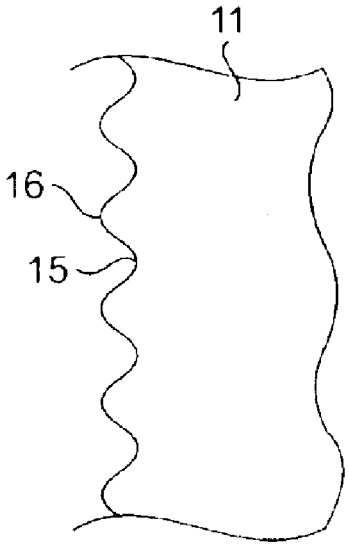
FIG. 3 is a side view detail of a receiver embodiment.
Figure 4:
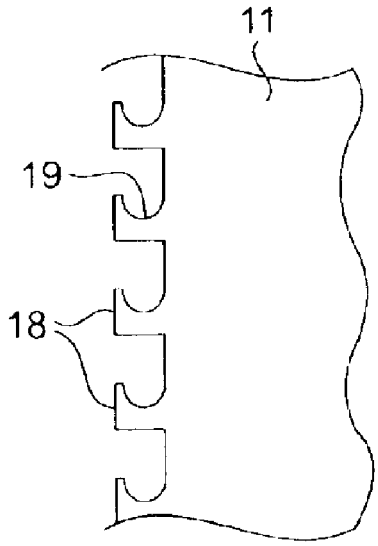
FIG. 4 is another side view detail of a receiver embodiment.

The narrow vertical edges of receiver 11 are provided with means to keep strands wrapped around the receiver from slipping downward. One mechanism for preventing downward slippage is edge indents 15 which may take several forms. For example, the edge profile of FIGS. 1 and 2B forms a saw-tooth effect of indents 15 between nubs 16, placed at intervals along the vertical edge of receiver 11. In the edge profile shown in FIG. 3 the nubs 16 are rounded. The edge profile of FIG. 4 features hook extensions 18 spaced along the vertical edge of receiver 11 and depressions 19 formed between hook extensions 18. Strand slots 20 formed at the top and the bottom of receiver 11, aid in threading light strands 21 onto receiver 11.

Figure 5:
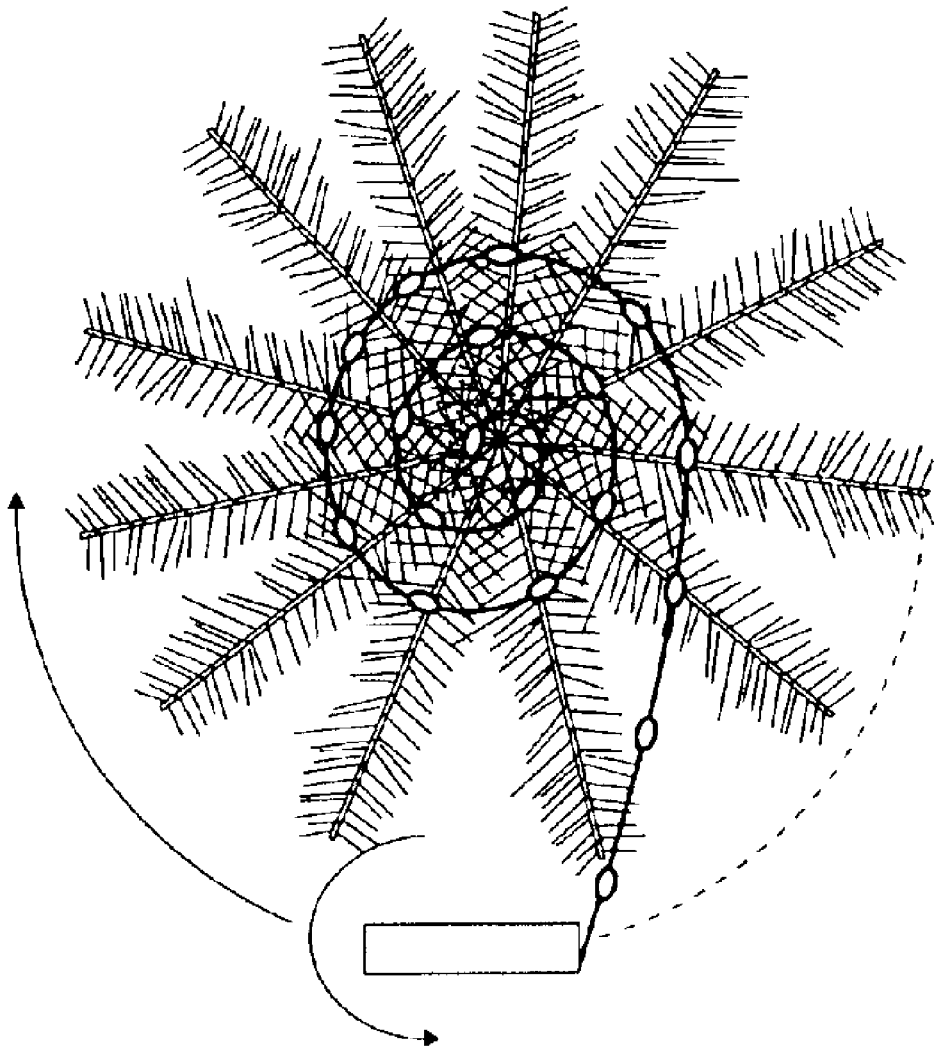
FIG. 5 is a top view sketch showing movement during installation of light strands.

Light strands 21 are mounted onto receiver 11 by directing a lead end of a strand into slots 20 at the top near handle 14. The light strands 21 then are splayed around and down receiver 11 as the device 10 is rotated. Once the interior layer of light strands 21 are wrapped onto receiver 11, the additional wrap layers of strands 21 stay firmly in position wrapped on the interior strand layer. Light strands 21 are distributed to a holiday tree as illustrated in FIG. 5 by a reverse process of translating the device 10 around a tree and concurrently rotating the device.

Figure 2A:
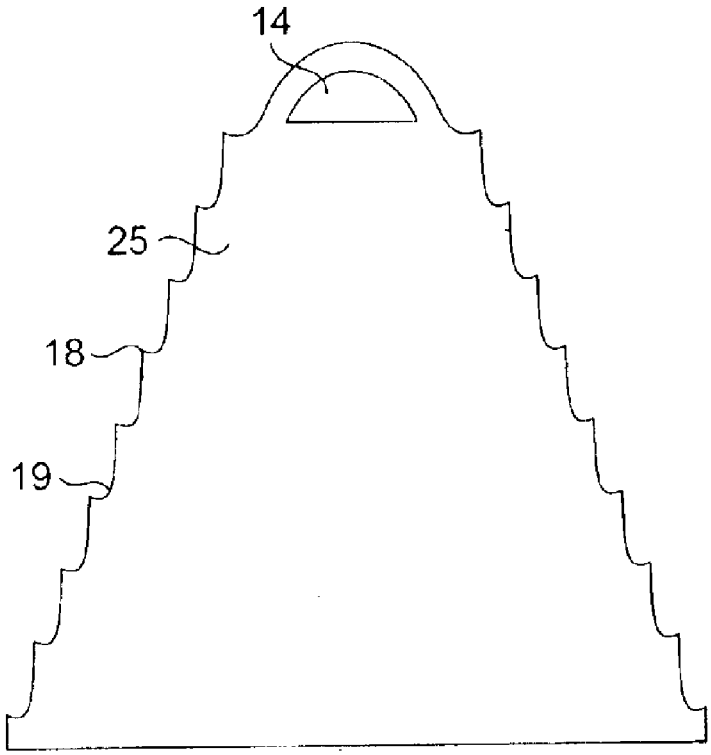
FIG. 2A is an isometric sketch of an alternative receiver.
Figure 6:
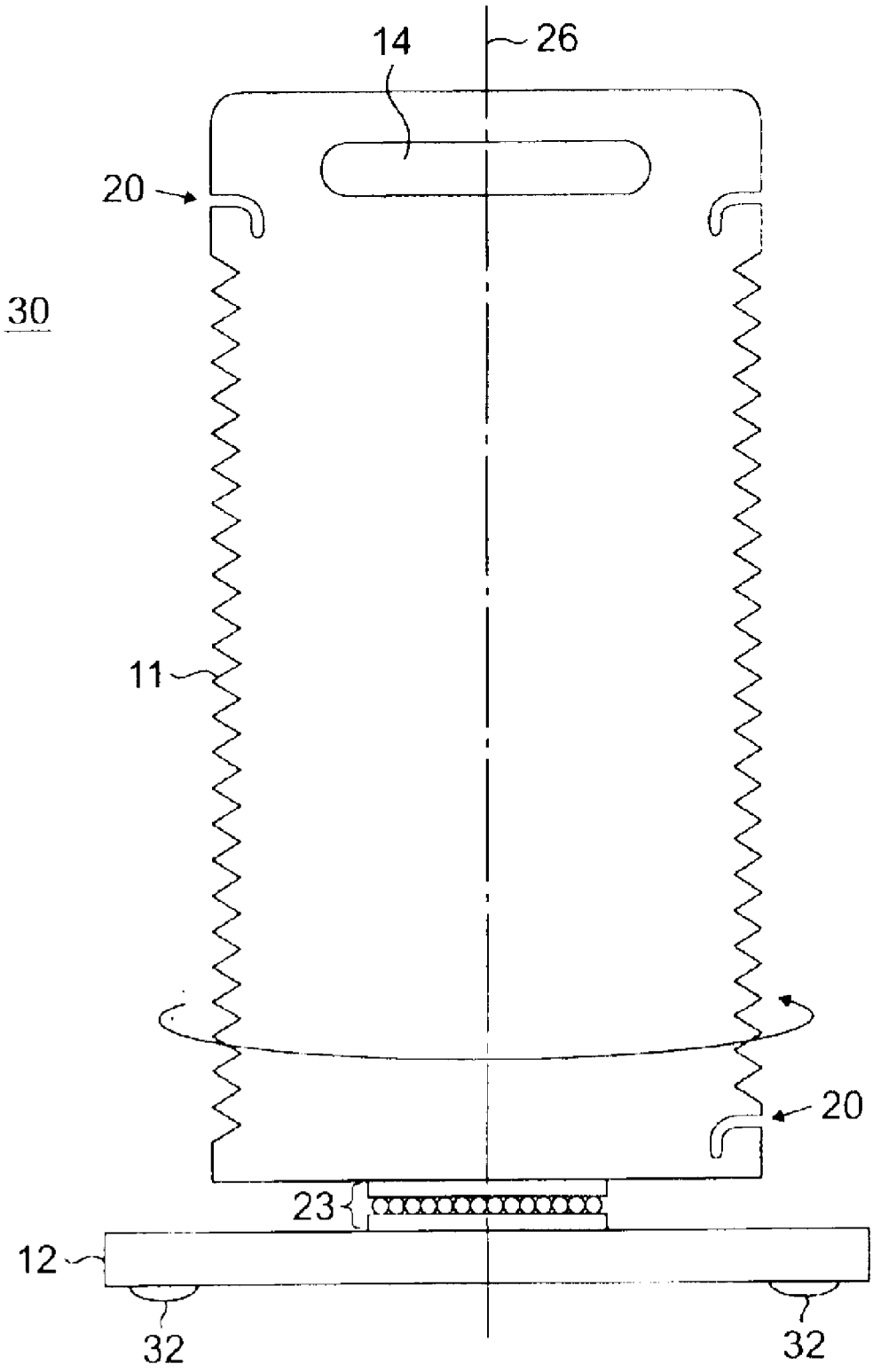
FIG. 6 is an elevation view sketch showing a rotatable receiver/base version.

A variation on the FIG. 1 design of the strand receiver is shown in FIG. 2A, where a receiver 25 is formed in a decorative tapered shape suggestive of a tree and particularly a Holiday tree. The receiver 25 details including handle 14, hook extensions 18 and depressions 19, and the manner of affixing receiver 25 to a base such as base 12 are as described above for receiver 11 of FIG. 1, Another variation of a light strand-mounting device wherein the receiver is intended to remain attached to its base is seen in FIG. 6. Light strand mounting device 30 consists of receiver 11 attached to a base 12 by a lazy-Susan type bearing 23. Use of bearing 23 enables receiver 11 to be rotated with respect to base 12 around a central axis 26. Bearing 23, and other types of bearings called for hereinafter, may be obtained from sources such as Kaydon Corporation, 315 E. Eisenhower Parkway, Ann Arbor Mich., 48108. Base 12 is made of material having low coefficient of moving friction, enabling the base/receiver assembly to be slid along a floor or rug. Alternatively, low friction sliders 32 are mounted on the underside of base 10 to serve the same purpose as castors. The receiver 11 of FIG. 6 is equipped with a corrugation edge profile comprising nubs 16 forming indents 15; but other edge profiles as earlier described may be used.

Figure 7:
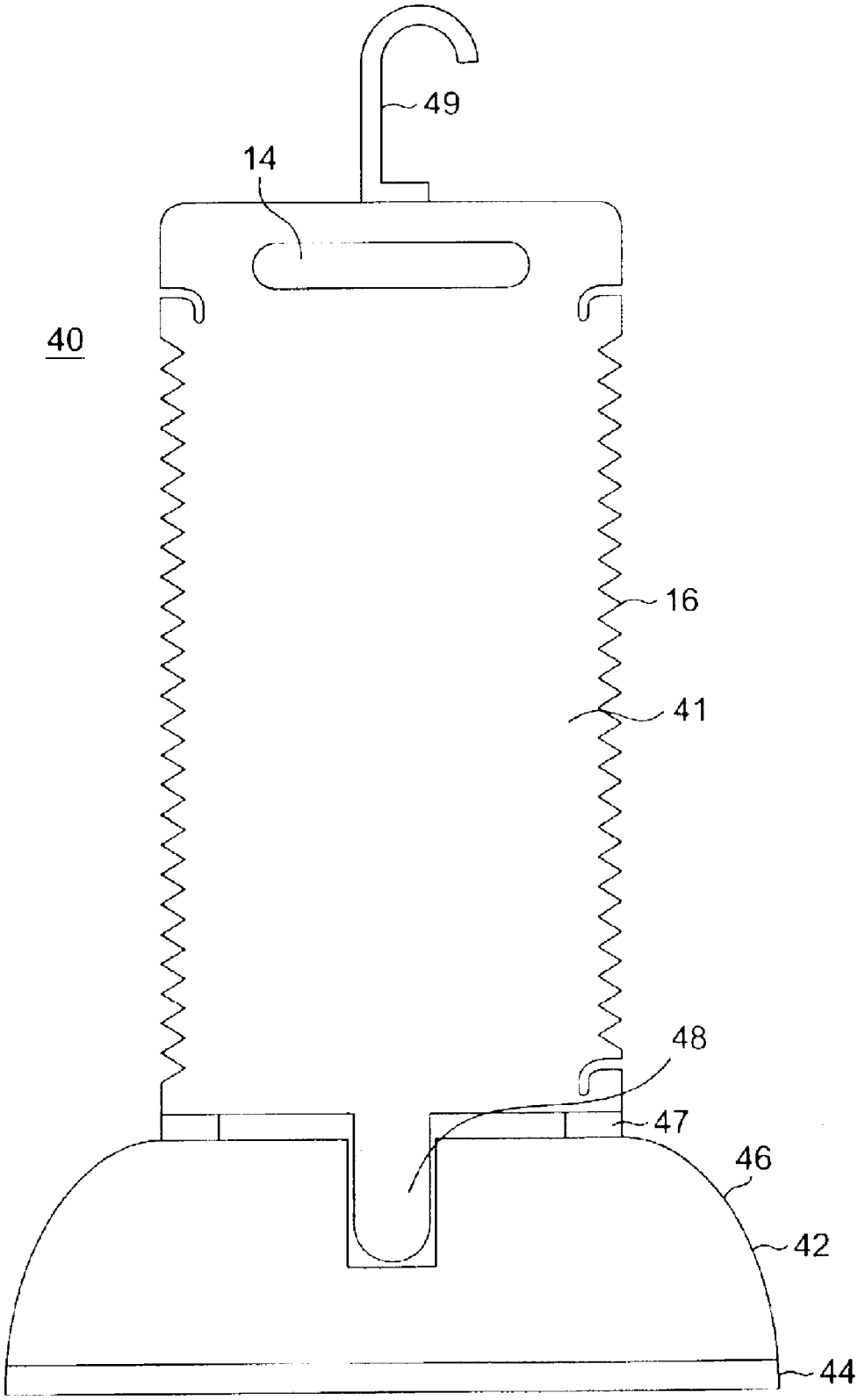
FIG. 7 is an elevation view sketch showing another rotatable receiver/base version.
Figure 8:
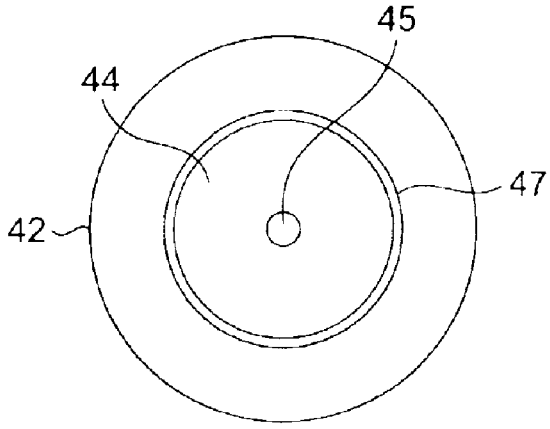
FIG. 8 is a top view sketch of the base of FIG. 7.

In another embodiment of the invention illustrated in FIG. 7, the rotation of a strand receiver is realized by means for detachably and rotatably mounting the receiver to the base. A light strand-mounting device 40 consists of receiver 41 rotatably mounted on a base 42 by a shaft 48 extending from the bottom of receiver 41 and engaging into a circular cavity 45 in the center of the base illustrated in FIGS. 7 and 8. A circular perimeter bearing 47 fixedly mounted on flat top surface 44 at the edge of rounded shoulder 46 provides low friction contact between receiver 42 and base 41. Bearing 47 provides sliding contact and separation between base 42 and receiver 41. A suitable bearing type for this application is known in the trade as a stewing ring bearing. Receiver 41 uses the profile of nub indents 16; but any of the alternative edge profiles described herein may be used instead. Device 40 is shown as having a slide 44 made for example of a plastic material having a low coefficient of moving friction. Slide 44 enables device 40 to be moved in a horizontal plane to position it around an object. Alternatively, sliders 32 such as shown in FIG. 6, which are typically a low-friction coefficient plastic, may be used.

Figure 9:
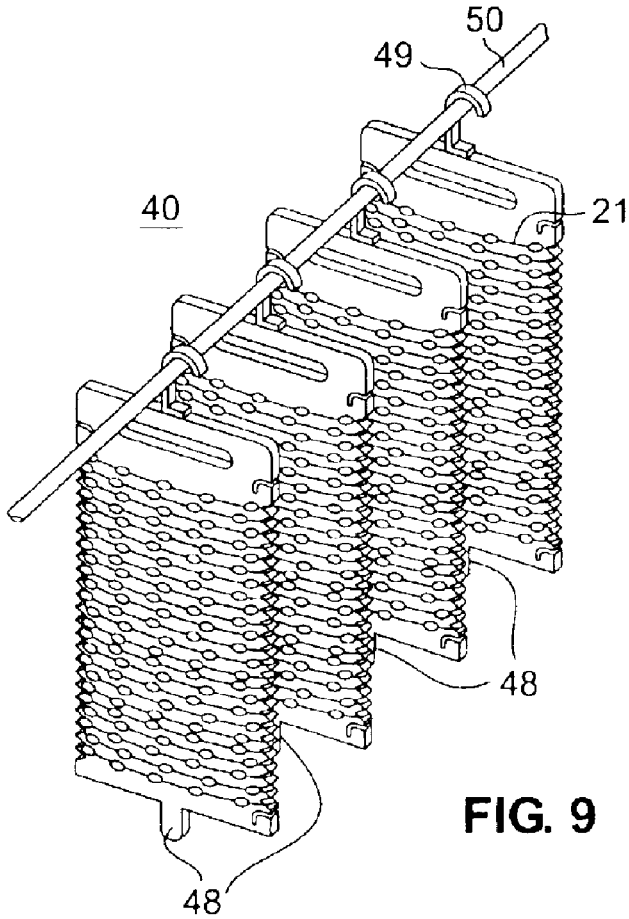
FIG. 9 is an isometric sketch showing hanging storage of the receiver of FIG. 7.

In addition to a handle 14 which functions as earlier noted, light strand mounting device 40 also incorporates a hanger 49. Because receiver 41 may be removed from base 42 by simply lifting extension 48 out of cavity 45, it is possible to store the device 40 with its wrapped light strands 21 by placing the device on a closet or attic hanger rod 50 as shown in FIG. 9. Any number of devices 40 may be so stored. Detachability of base and receiver also simplifies shipping and assembly, by allowing base and receiver to be stacked flat in a box for shipping and assembled with no requirement for connection hardware.

Figure 10:
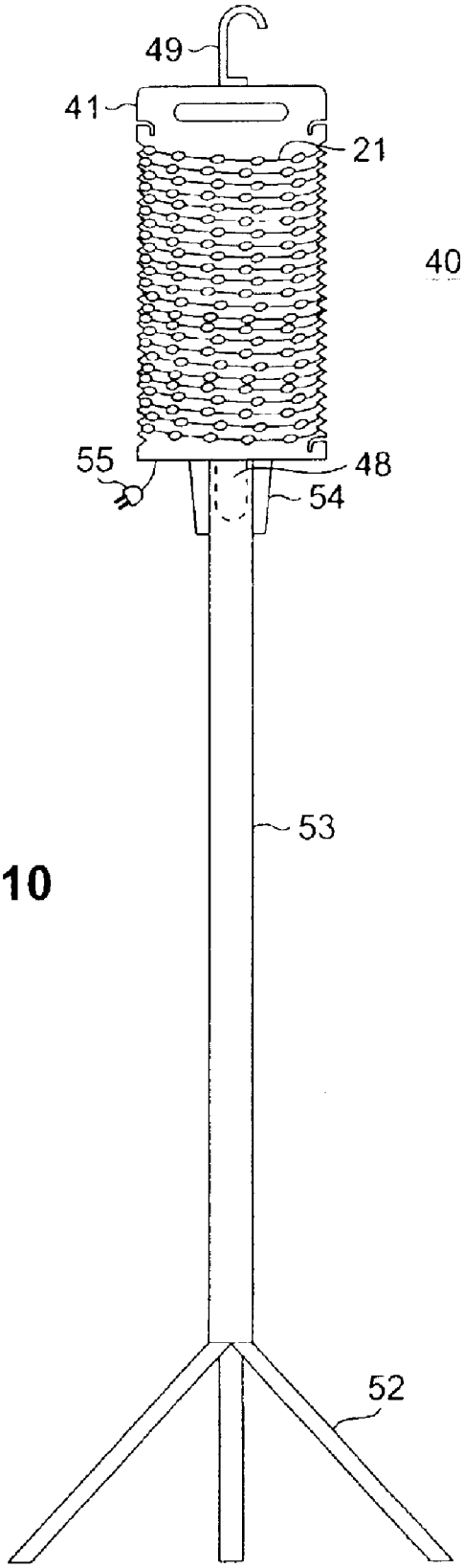
FIG. 10 is an isometric sketch showing receiver of FIG. 7 mounted on a lamp base.

Unique advantage may be taken of the device design 40 because of its shaft extension 48. Specifically, rather than limiting the mounting device to strand storage, installation and take-down, a light strand-wrapped device 40 may be combined with an appropriate base 52 and upright 53 to form a light source. Referring to FIG. 10, a device 40 with installed light strands 21 may be supported in a vertical mode by accommodating its extension 48 into a collar 54 of an upright 53. By adding an extension cord connected to a plug end 55 of strands 21, novel and effective portable lighting is provided. An alternative to mounting device 40 onto the stand of FIG. 10 is to hang device 40 by itself from its hook hanger 49 from any available structure such as a tree limb. Using device 40 in the manner described, accent lighting made up of strands of dark light coloration (dark green, dark blue, dark red) may be created; or area lighting using white (or predominately white) may be created.

FIG. of FIG. 6 may facilitate translation of device 60 along a floor surface.

Device 60 may also be used as an alternative light source in the manner described earlier f11 depicts a light strand-mounting device 60 similar in operating principle to device 40 of FIG. 7, in that its receiver 61 also detachably mounts on its base 68. Receiver 61 is formed in two mating halves consisting of first and second upright side members 62, 63. Each side member 62, 63 is generally U-shaped in cross-section to create interior space 64. Base 68 includes a receiver mounting pad 69 having cavities 70 shaped to receive legs 67 formed along the bottom edge of each side member 62, 63. To retain the wrapped strands in place and prevent downward slipping, nub extensions 65 are formed vertically outwardly from at least one edge of one of the side members 62, 63. Each adjacent pair of extensions 65 form wells 66 into which light strands are fed.

Figure 11:
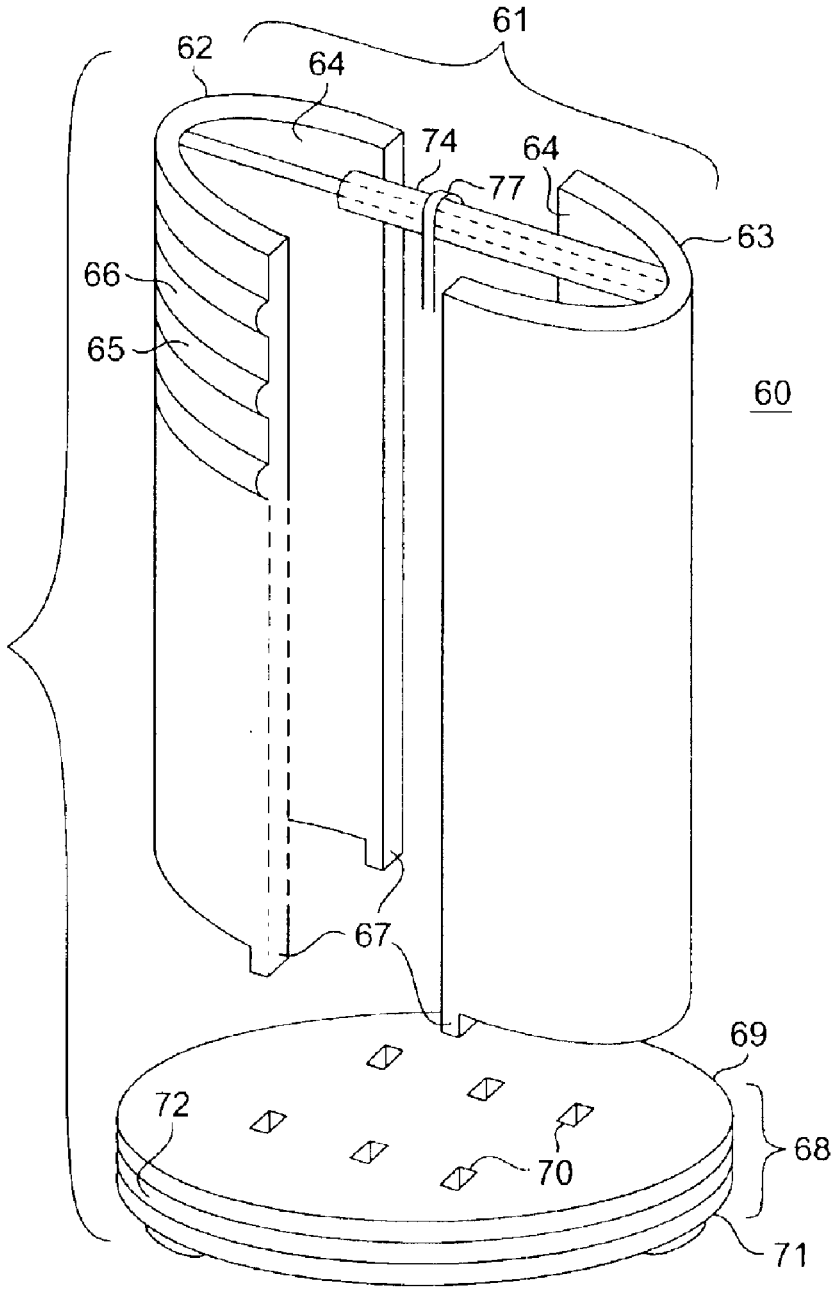
FIG. 11 is an isometric sketch showing still another rotatable receiver/base version.

Cavities 70 are formed in a pattern to enable the two side members 62, 63 to be spaced apart in various degrees of separation. A substantial separation is shown in FIG. 11. Side members 62, 63 may instead be butted up against each other in edge contact. The ability to vary the distance between side members 62, 63 allows the light strand packing density to be varied. This feature is advantageous when long lengths of light strands must be accommodated, as in the case of managing outdoor string lighting. Telescoping rod 74 mounted between the top edges of side members 62, 63 provides stabilization and helps maintain the separation of side members 62, 63. Rod 74 also provides a place on which to store strands of Holiday tree tinsel 77.

Figure 12:
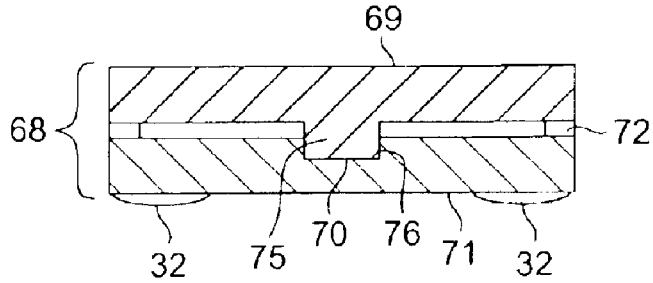
FIG. 12 is a side view sketch of the base assembly of FIG. 12.

As shown in FIG. 12, rotational movement of receiver 61 in relation to base 68 is enabled by a perimeter bearing 72 permanently mounted on undercarriage 71. Bearing 72 allows receiver mounting plate 69 to rotate with respect to undercarriage 71. Mounting plate 69 is formed with a shaft extension 75 that fits into a center recess 76 formed in undercarriage 71 to center plate 69 on perimeter bearing 72. Sliders 32 such as are used in the version or device 40 of FIG. 10. Device 60 may be suspended from its telescoping rod 74 in an area to be illuminated. If disposed in its open position as shown in FIG. 11 as a light source, device 60 provides an appealing visual effect by energy from the strand lights playing off any tinsel stored within the interior space 64, thereby to create a shimmering effect.

Figure 15:
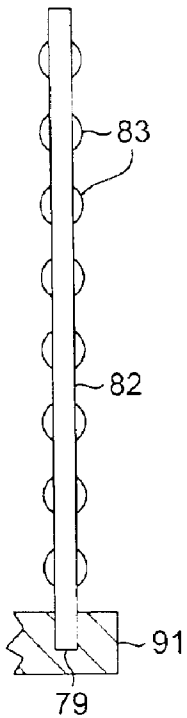
FIG. 15 is an elevation view sketch of the spindle receivers of FIG. 13.
Figure 13:
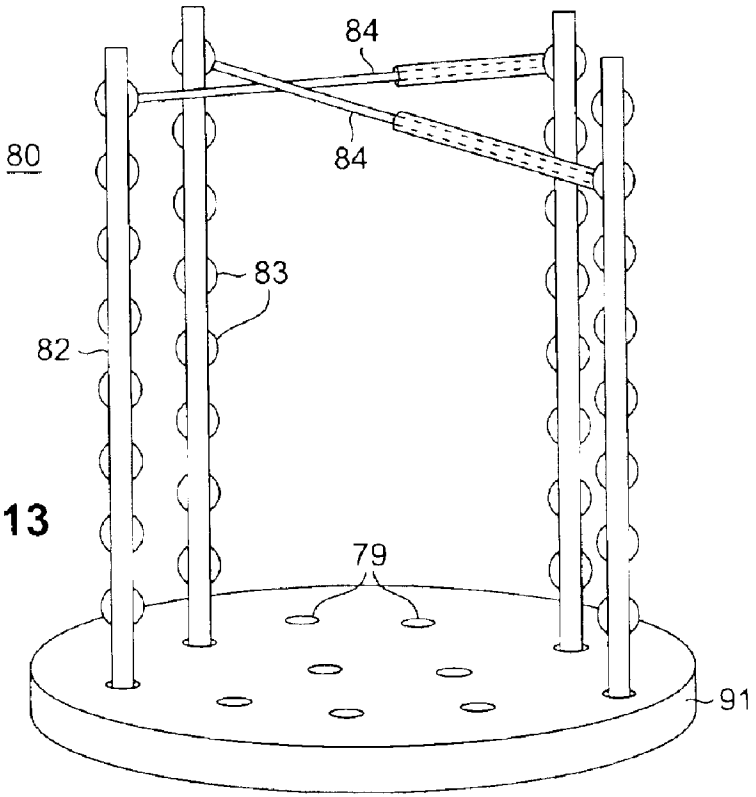
FIG. 13 is an isometric sketch showing still another rotatable receiver/base version.
Figure 14:
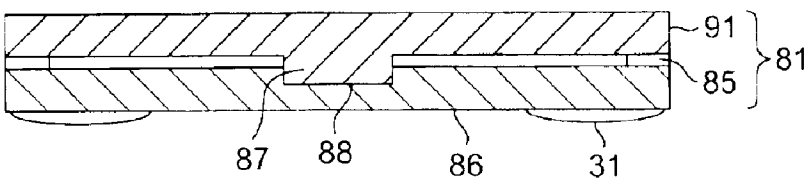
FIG. 14 is a side view sketch of the base assembly of FIG. 13.

FIGS. 13, 14 and 15 illustrate another embodiment of a rotatable and translatable light strand mounting device. This device 80 consists of a base 81 that includes a mounting plate 91 formed with multiple orifices 79 in its top surface. Spindles 82 mount upright in receptacles 79. Each spindle 82 is formed with circular rings 83 which prevent mounted light strands from collapsing downward during storage. Light strands are stored by wrapping them around the exterior appearances of rings 83 on the spindles 82. The number of spindles used to provide strand wrapping capability can vary from 2 to 4 or more. One or more telescoping rods 84 are fastened between opposing spindles 82 to provide added lateral strength and to afford a place for mounting tinsel.

Mounting plate 91 is rotatably supported on a perimeter bearing 85 placed between plate 91 and an undercarriage 86. Bearing 85 is permanently affixed between plate 91 and undercarriage 86. Plate 91 includes a center shaft 87 extending from its bottom surface into engagement in a well 88 formed in undercarriage 86. Undercarriage 86 includes floor sliders 89 disposed along the bottom surface to enable device 80 to translate along a floor surface.

The base and receiver elements herein described may be fabricated of wood or a wood product. Alternatively they may be made of plastic materials formed by conventional plastic injection molding techniques.

What is claimed is:

1. A light strand-mounting device comprising:

a light strand receiver, a floor surface-contacting base, mounting means for vertically supporting said receiver on said base, means formed into said receiver for vertically restraining light strands wrapped thereon, means for enabling rotation of said receiver around a vertical axis, and means for enabling translation of said base and said light strand receiver in any direction along said floor surface, said means for enabling rotation of said receiver around a vertical axis and said means for enabling translation of said base along a floor surface comprising plural castors mounted from the underside of said base, whereby light strands are installed and released from said receiver by the combination of rotating said receiver and translating said base.

2. The light strand mounting device of claim 1, wherein:

said base and said strand receiver each comprise a flat, rectilinear non-conductive material, and said vertical restraining means comprise a plurality of indents formed along opposite vertical edges of said receiver for confining an inner wrapping of light strands.

3. The light strand mounting device of claim 2, wherein:

said receiver further comprises a hand grip located along the top edge of said receiver and extending beyond said light strand confining indents.

4. The light strand mounting device of claim 3, wherein:

said base comprises a flat, rectilinear non-conductive material, and said light strand receiver comprises a flat nonconductive material shaped as a holiday tree form, said form further comprising a plurality of indents formed along opposite vertical edges of said holiday tree form for confining an inner wrapping of light strands.

5. An electric light strand utility holder for travel on a horizontal floor or rug surface and for unraveling and raveling a strand from said holder onto and off of a holiday tree, said holder comprising:

a floor or rug surface-contacting base, an upright light strand receiver mounted on said base, means formed into said receiver for vertically restraining light strands wrapped thereon, means extending downwardly from said base and selected from the group consisting of wheel castors and low friction plastic sliders, for enabling translational movement of said base and said light strand receiver in any direction along said floor or rug surface, and means for enabling rotation of said receiver in relation to said base, whereby light strands are installed and released from said receiver by the combination of rotation of said receiver and translation of said base.

6. The electric light strand utility holder of claim 5, wherein said receiver comprises first and second upright side members, each said side member being U-shaped in cross-section, said first and second side members having vertical edges and a bottom edge, and a plurality of legs extending down from said bottom edge, and wherein said base comprises a receiver-mounting plate having plural sets of cavities to receive said legs to position the opposing said vertical edges of said first and second upright members in varying degrees of separation.

7. The electric light strand utility holder in accordance with claim 5, wherein said receiver comprises a plurality of upright spindles, each said spindle comprising rings disposed lengthwise;

and wherein said base comprises a mounting plate comprising a center shaft, a plurality of cavities for receiving and spacing two or more said spindles at varying distances, a perimeter bearing contacting said mounting plate, and an undercarriage comprising a center well for receiving said shaft and means for mounting said perimeter bearing.

* * * * *